US010022727B2

(12) United States Patent
Alam

(10) Patent No.: US 10,022,727 B2
(45) Date of Patent: Jul. 17, 2018

(54) DISCHARGE ELECTRODE SUSPENSION SYSTEM USING RINGS

(71) Applicant: Ohio University, Athens, OH (US)

(72) Inventor: Khairul Alam, Athens, OH (US)

(73) Assignee: Ohio University, Athens, OH (US)

( * ) Notice: Subject to any disclaimer, the term of this patent is extended or adjusted under 35 U.S.C. 154(b) by 0 days.

(21) Appl. No.: 14/917,985

(22) PCT Filed: Sep. 25, 2014

(86) PCT No.: PCT/US2014/057409

§ 371 (c)(1),
(2) Date: Mar. 10, 2016

(87) PCT Pub. No.: WO2015/048255

PCT Pub. Date: Apr. 2, 2015

(65) Prior Publication Data

US 2016/0221003 A1 Aug. 4, 2016

Related U.S. Application Data

(60) Provisional application No. 61/882,027, filed on Sep. 25, 2013.

(51) Int. Cl.

| | |
|---|---|
| ***B03C 3/60*** | (2006.01) |
| ***B03C 3/41*** | (2006.01) |
| ***B03C 3/04*** | (2006.01) |
| ***B03C 3/47*** | (2006.01) |
| ***B03C 3/86*** | (2006.01) |

(52) U.S. Cl.
CPC ..... *B03C 3/60* (2013.01); *B03C 3/04* (2013.01); *B03C 3/41* (2013.01); *B03C 3/47* (2013.01); *B03C 3/86* (2013.01)

(58) Field of Classification Search
CPC combination set(s) only.
See application file for complete search history.

(56) References Cited

U.S. PATENT DOCUMENTS

| | | | | |
|---|---|---|---|---|
| 2,601,906 A * | 7/1952 | Wintermute | ..... | B03C 3/86 96/91 |
| 2,881,857 A * | 4/1959 | Cosby | ..... | B03C 3/41 96/89 |
| 2,937,711 A * | 5/1960 | Roberts | ..... | B03C 3/40 96/29 |
| 3,055,159 A * | 9/1962 | Gonzalez | ..... | B03C 3/86 242/379 |

(Continued)

FOREIGN PATENT DOCUMENTS

WO 2011005947 1/2011

*Primary Examiner* — Robert A Hopkins
*Assistant Examiner* — Sonji Turner
(74) *Attorney, Agent, or Firm* — Jason H. Foster; Kremblas & Foster

(57) ABSTRACT

A discharge electrode with equal or better performance to conventional discharge electrodes, but at significantly lower cost uses carbon fiber composite tapes suspended around support rings attached to a support at the top and a bias at the bottom. The tape is in a loop and extends around the support rings, causing the rings to be pulled apart in tension by the bias to keep the tape taut. The tape, and preferably the top ring, and alternatively the lower ring, are conductively connected to a power supply.

8 Claims, 7 Drawing Sheets

(56) References Cited

U.S. PATENT DOCUMENTS

| | | | | | |
|---|---|---|---|---|---|
| 3,485,011 | A | * | 12/1969 | Archer et al. | B03C 3/41 95/81 |
| 3,966,436 | A | * | 6/1976 | Archer | B03C 3/41 96/91 |
| 4,035,886 | A | | 7/1977 | Gluck | |
| 4,058,377 | A | | 11/1977 | Schminke et al. | |
| 4,134,040 | A | * | 1/1979 | Klotzman | B03C 3/86 248/339 |
| 4,239,514 | A | | 12/1980 | Junkers | |
| 4,276,056 | A | | 6/1981 | Pasic et al. | |
| 4,321,067 | A | | 3/1982 | Gupner et al. | |
| 5,792,243 | A | * | 8/1998 | Meffert | B03C 3/64 313/355 |
| 6,231,643 | B1 | * | 5/2001 | Pasic | B03C 3/47 95/75 |
| 7,976,616 | B2 | | 7/2011 | Alam | |
| 9,114,404 | B2 | * | 8/2015 | Alam | B03C 3/41 |
| 2008/0190296 | A1 | | 8/2008 | Alam | |
| 2009/0274592 | A1 | * | 11/2009 | Bergeron | B03C 3/09 422/186.29 |
| 2011/0056376 | A1 | | 3/2011 | Pasic | |
| 2012/0227588 | A1 | | 9/2012 | Alam | |

* cited by examiner

DISCHARGE ELECTRODE SUSPENSION SYSTEM USING RINGS

BACKGROUND OF THE INVENTION

The invention relates generally to particulate collectors using electrostatic forces, and more particularly to discharge electrode systems for use in an electrostatic precipitator.

Electrostatic precipitators (ESPs) are devices used to collect particles from gas streams, such as the gas streams from electric power plants burning coal. Charging electrodes (also called "discharge electrodes") are critical components used in ESPs. Examples of such devices are shown in U.S. Pat. No. 6,231,643 to Pasic, et al., U.S. Pat. No. 7,976,616 to Alam, United States Patent Application Publication No. US2011/0056376 published Mar. 10, 2011, and United States Patent Application Publication No. US2012/0227588 published Sep. 13, 2012, all of which are incorporated herein by reference.

In a typical conventional ESP 2, shown in FIG. 9, vertical wire electrodes 4 are placed in the midsection of a channel formed between vertical parallel collector substrates 6. The most basic ESP contains a row of wires followed by a stack of spaced, planar metal plates. The heavy, typically steel, plates 6 are suspended from a support structure that is anchored to an external framework. Commonly, ten of the single precipitation channels constitute a single field. Industrial precipitators have three or more fields in series. An example of such a structure is shown and described in U.S. Pat. Nos. 4,276,056, 4,321,067, 4,239,514, 4,058,377, and 4,035,886, which are incorporated herein by reference.

A high-voltage DC power supply, typically of about 50 kV, is applied by a high voltage power supply 8 disposed electrically between the wire discharge electrodes 4 and the grounded substrate collector plates 6 (also called "collecting electrodes"), inducing a corona discharge between them. This transfers electrons from the plates to the wires, developing a negative charge of thousands of volts on the wires relative to the collection plates. In a typical ESP, the collection plates are grounded, but it is possible to reverse the polarity.

The gas stream and particles flow through the spaces between the wires, and then pass through the rows of plates. During this flow, the gases are ionized by the charging electrode, forming a corona. As particles are carried through the ionized gases, the particles become negatively charged. A fraction of ions, which migrate from the wires towards the plates, attach to the dust particles in the exhaust gas flowing between the plates 6. When the negatively charged particles move past the grounded collection plates, the strong attraction causes the particles to be drawn toward the plates until there is impact. These particles are then forced by the electric field to migrate toward, and collect on, the plates where a dust layer is formed. When the particles contact the grounded plate, they give up electrons, and thus act as part of the collector to future impacting particles.

In dry ESP's, the dust layer is periodically removed from dry ESPs by hammers imparting sharp blows to the edges of the plates 6, typically referred to as "rapping" the plates. Automatic "rapping" systems and hopper evacuation devices remove the collected particulate matter while the ESPs are being used, thereby allowing ESPs to stay in operation for long periods of time.

ESPs perform better if the corona is stronger and covers most of the flow area. This prevents particles that would otherwise flow around the charging zones and escape being charged, which is called "sneakage". Discharge electrodes have been developed that include rigid structures to which many sharpened spikes are attached, maximizing corona production.

Conventional discharge electrodes are supported on a metal structure, which typically includes a support rod. The rods are conductive in order to electrically connect each spike point with the power supply. Generally, it is considered necessary to have metal spikes that can withstand the electrical currents that often flow due to sparking over between the collection substrate and discharge electrode. Existing discharge electrodes are typically made of metal, which can be quite heavy. In corrosive operating conditions, the charging electrodes are typically made of an expensive alloy (e.g., HASTELLOY brand metal) to avoid or mitigate corrosion in the harsh environments in which such electrodes are used. Since the entire discharge electrode, including the support rod, is commonly made of the same alloy, the electrodes become expensive and heavy, thereby requiring strong support structures.

Two types of electrodes are most commonly used in the industry. The first is an elongated tube with sharp spikes protruding outwardly in different directions using different geometries. The second is a suspended wire electrode that is tensioned by a weight hanging at the bottom of the wire. The existing designs are costly when the discharge environment is corrosive (e.g. in a wet ESP), and the highest discharge current attained by conventional electrodes may not be satisfactory for any environment.

Therefore, the need exists for a discharge electrode that is lightweight and inexpensive, but which has a sufficient current flow to produce high discharge currents and particle collection efficiency along with low susceptibility to corrosion.

BRIEF SUMMARY OF THE INVENTION

Polymers are inexpensive, light and corrosion-resistant, but they do not conduct electricity, and they have poor tensile/flexural strength. Composites exist that are conductive, but such composites typically have much lower conductivity than metals. Several non-metallic alternates have been developed to meet these requirements, and examples include composite tapes and carbon fiber electrodes.

A feasible, low cost electrode design is disclosed for suspending conductive composite strands or tapes so that a high discharge current is maintained. A goal is to provide a low cost alternative to current metal discharge electrodes that are corrosion-resistant in applications such as electrostatic precipitators. It should be noted that the carbon fiber tape electrode is expected to have significant cost advantage, and therefore the same performance from the new electrode is considered very advantageous compared to a conventional electrode of substantially greater cost.

The new design uses tapes or strands suspended on one or more loop supports. Fibers and tapes are put in tension by a weight or support structure at the bottom of the electrode without using a rigid support between the loop supports. The weight or support structure applying a force to keep the fibers and tapes taut is referred to herein as a "bias".

The invention suspends multiple fibers, strands or tapes on a frame in manner that maximizes the discharge current from the fibers, strands or tapes. Discharge current is enhanced in conductive fiber composites, for example, by the tips and/or surfaces (along the fibers' lengths) that form "points" to encourage corona formation. Because the fibers have such a small diameter, their tips act as sharp points, and surfaces along the fibers' lengths serve as "points" due to their extremely small diameter. A simple suspension system has been developed and is disclosed herein that can be adapted for retrofit in current ESP installations.

The invention contemplates a new design of charging electrodes using carbon fibers to generate the corona discharge. The cost problem in the prior art is addressed in the invention by using polymer-reinforced composite tapes made with conductive fibers, or by using conductive fibers alone, to produce the discharge electrode. The corrosion issue is addressed in the invention by using carbon fibers and corrosion-resistant polymer-based composite materials.

Joining non-metallic electrodes to a traditional metal support structure is addressed by technologies for putting a metallic coating on the polymer tape or carbon fibers to produce a metallic contact. Other choices include conductive adhesives or simple pressure contacts.

The invention contemplates electrodes made of carbon or other conductive fibers within a polymer matrix to form a composite. Composites are typically much lighter than metals conventionally used as discharge electrodes, and therefore the weight of the electrode is reduced in comparison to the prior art. Composites have high strength and can be used to fabricate electrodes of high durability and long operating life.

The technology disclosed herein has strong potential applications in pollution control used in boiler exhausts, dry and wet ESPs and air-purifiers. The invention has several advantages over other commercially available charging electrodes, including improvement in the charging characteristics of the electrode; lower cost of the electrodes due to use of inexpensive, lighter materials and simpler design; and lower cost of overall equipment as the cost of any supporting structure is eliminated or reduced. Furthermore, variations in the composition and physical configuration of the electrodes are feasible depending on the requirements and conditions of their operation, and collection efficiency is improved due to improvement in the airflow pattern. Corrosion resistance is enhanced in environments that would adversely affect metallic electrodes.

Figure 1:
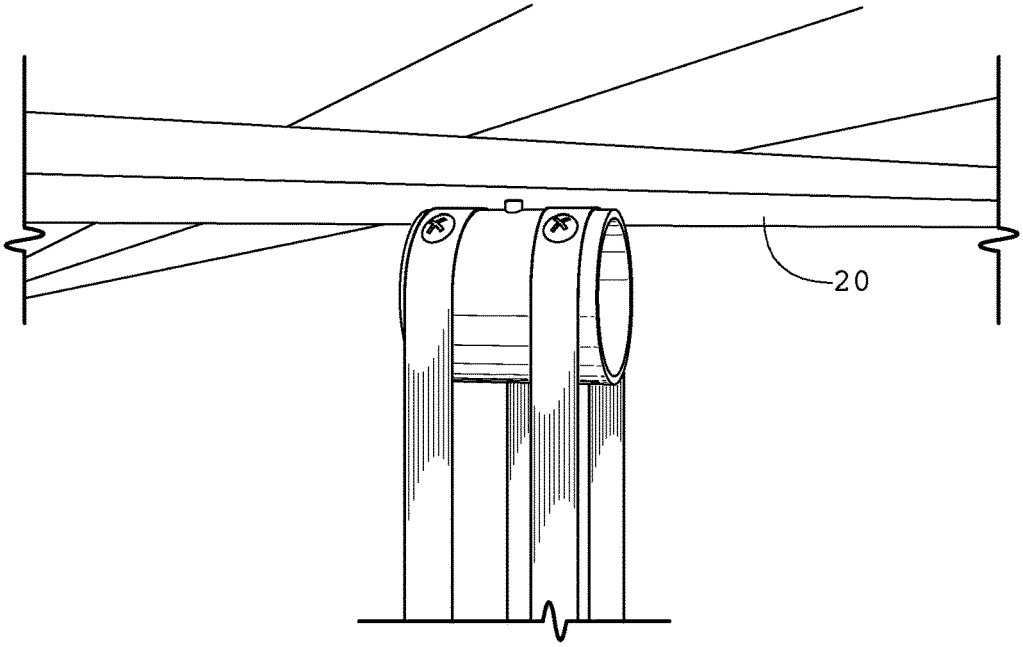
FIG. 1 is a side view illustrating an embodiment of the invention in which two loops of composite tape are suspended from a ring to form a discharge electrode.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

U.S. Provisional Application No. 61/882,027 filed Sep. 25, 2013, which is the above claimed priority application, is incorporated in this application by reference. Earlier discharge sources are described in an earlier patent application (Reference: PCT WO 2011/005947 A1), which is incorporated herein by reference.

Figure 10:
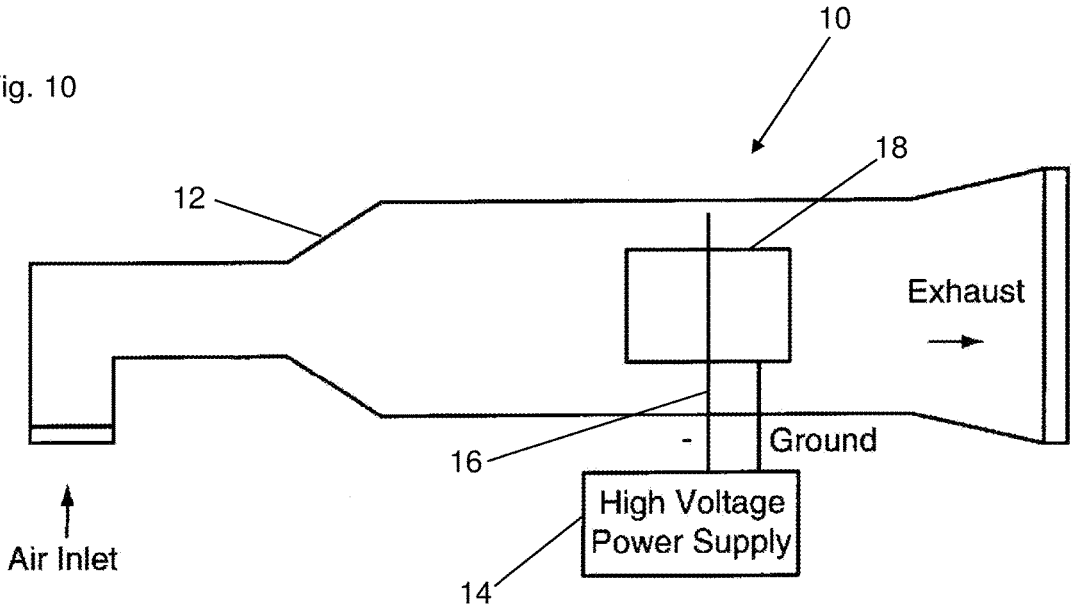
FIG. 10 is a schematic illustration of an electrostatic precipitator including the present invention.

An electrostatic precipitator 10 with which an embodiment of the present invention is used is shown in FIG. 10. Ambient air and dust are blown into a smooth-walled tunnel 12 through the air inlet. A high voltage is applied by the power supply 14 between the vertical discharge electrode 16 and the vertical collection electrode 18 with the discharge electrode 16 having a negative polarity and the collection electrode 18 being grounded.

The discharge electrode 16, which can be of any type according to the invention as described in more detail herein, is about 10.0 feet long, but any suitable length is contemplated for the invention. Several different designs of discharge electrodes have been developed according to the invention, and are described in more detail below.

The discharge electrodes described herein preferably use carbon fiber reinforced polymer tape as the discharge source. A tape is substantially wider than it is thick, and the tapes described herein are formed in a loop. The fibers are preferably in the diameter range of about 5.0 microns to about 20.0 microns, and the polymer that infiltrates the fibers to form a matrix can be any thermoplastic or thermoset suitable for use in a composite. Of course, any suitable conductive fiber-reinforced composite could be substituted for the preferred carbon fiber reinforced polymer tape, and variations in the tape's conductivity, fiber diameter, fiber material, polymer material, exterior dimensions and other parameters are contemplated. It is also contemplated to use carbon or other fibers without a polymer matrix.

Several discharge electrode embodiments have been produced using a carbon fiber reinforced polymer composite tape as the discharge source. These embodiments are described below in reference to FIGS. 3, 4 and 5. The embodiments attach to a suspension support at the top end, such as the support 20 shown in FIG. 1, and preferably extend downwardly so that the electrode is disposed in a generally vertical orientation. However, there is no support structure, such as a stiff rod, between the top end and the bottom end of the discharge electrode of the present invention. Instead, the discharge electrode is kept in tension using a bias, which can be a hanging weight on the bottom end, or by attachment under tension to a support 22 at the bottom (see FIG. 2). The term "bias" is used herein to encompass a structure that applies a force to maintain the composite in a taut configuration. "Taut" is defined herein as tightly drawn by being pulled, and without slack. It is contemplated that some discharge electrodes will be oriented horizontally, or at least non-vertically, and in this orientation the bias may be a coil or other spring, or a pulley and weight configuration that applies a longitudinal force to the electrode using the force of gravity as the bias, despite the orientation of the electrode being non-vertical.

Figure 2:
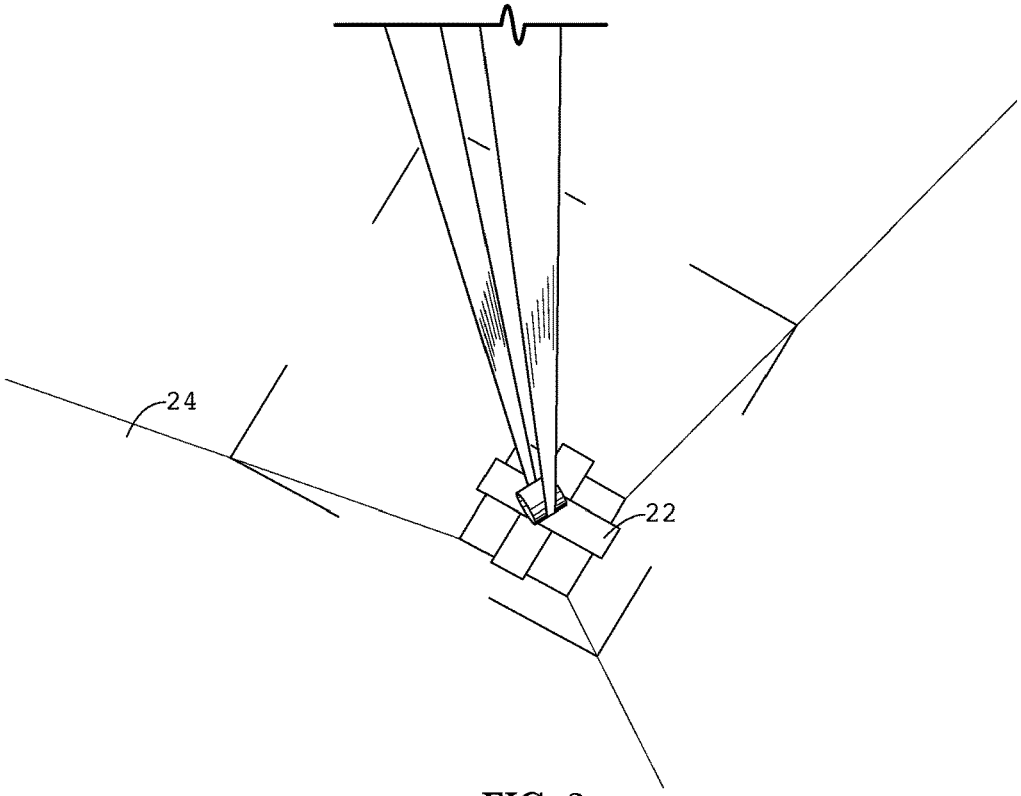
FIG. 2 is a view in perspective illustrating an embodiment of the invention in which a single loop of composite tape extends around a ring within a vertical ESP chamber.
Figure 3:
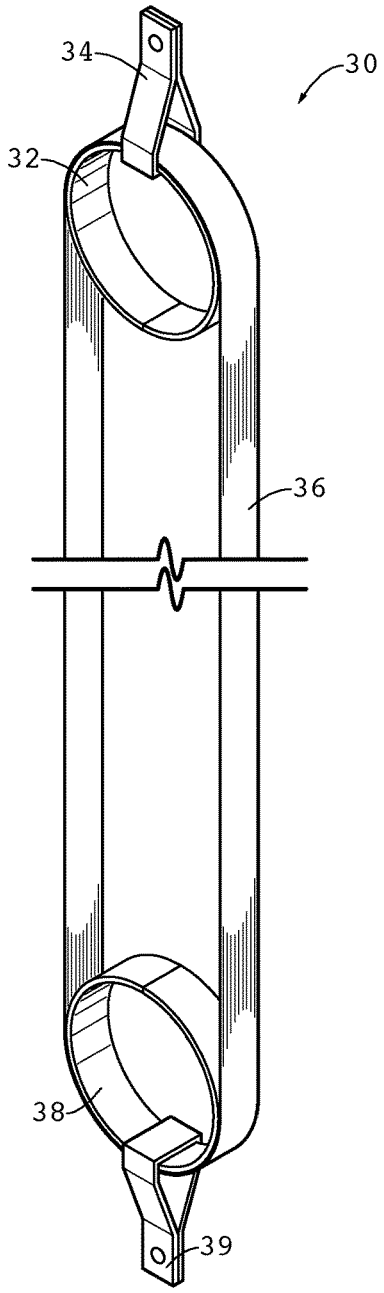
FIG. 3 is a view in perspective illustrating an embodiment referred to herein as "core design A".
Figure 4:
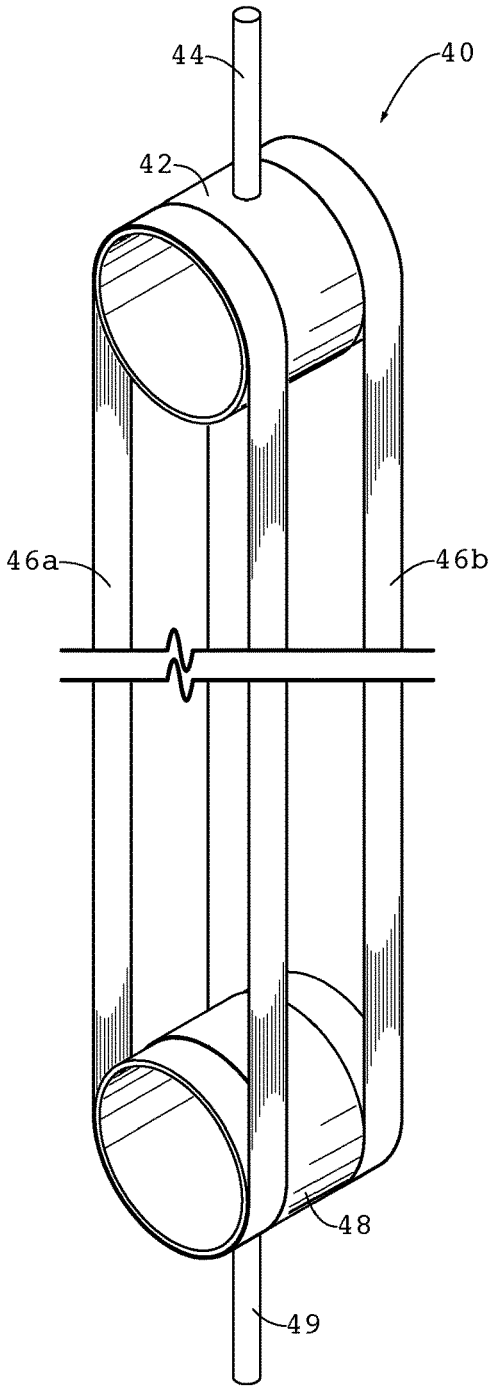
FIG. 4 is a view in perspective illustrating an embodiment referred to herein as "core design B".
Figure 5:
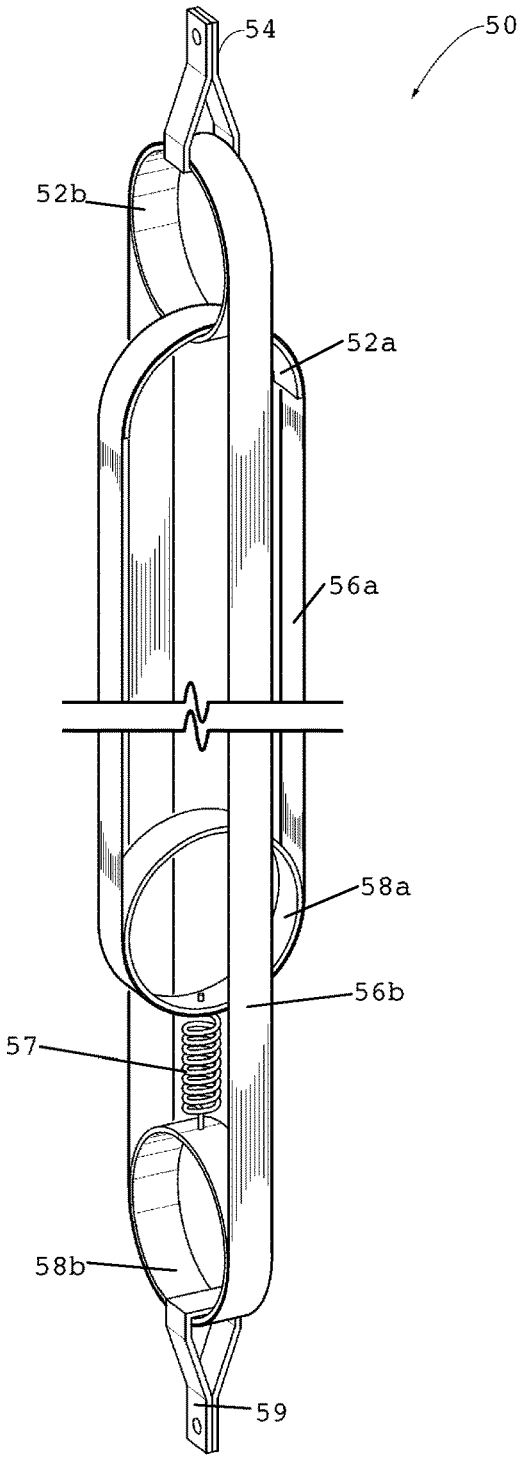
FIG. 5 is a view in perspective illustrating an embodiment referred to herein as "core design c".

The illustrations of FIGS. 1 and 2 show examples of fabricated electrodes and the suspension arrangement inside the ESP chamber, or an experimental chamber passage 24. The embodiments of FIGS. 3, 4 and 5, which are described below in detail, use a support (ring) to support the conductive composite tape electrode at the top and the bottom. The embodiment shown in FIG. 3 is a basic embodiment; the embodiment shown in FIG. 4 is enhanced to increase discharge current; and the embodiment shown in FIG. 5 is enhanced to increase discharge current in a symmetric fashion. These are described in turn below.

A first discharge electrode 30 according to the invention is shown in FIG. 3 having a top support ring 32. The ring 32 is a very short cylindrical ring preferably having a sidewall of the same thickness throughout the ring 32. The support can be other enclosed shapes (oval, irregular) and have variations in thickness, and the supports can also be non-enclosed shapes, such as arcs as described below. In a preferred embodiment, the ring can be formed by cutting a short length from a cylindrical metal pipe, which can be made of copper, aluminum, mild steel, stainless steel or any other conductive material or non-conductive material covered with a conductive coating or having a conductive insert therein. The preferably metal ring 32 is preferably welded or otherwise conductively mounted to a hanger 34, which can be folded sheet metal, and which is preferably conductively connected to the power supply (not illustrated).

The flexible, conductive strand, such as carbon fiber composite tape 36 as described herein extends in a loop around the top ring 32 and around a lower support ring 38, which is preferably the same or similar shape and size as the upper support ring 32, but can be any suitable material, including non-conductive plastic or polymer composite. A hanger 39 is preferably mounted to the lower support ring 38 in order to attach to a bias, such as the lower support 22 shown in FIG. 2 or a weight if the electrode 30 is vertically oriented.

Electrical conductivity from the top ring 32 and hanger 34 to the power supply is important, and therefore the conductive, flexible tape 36 is preferably fixed to the support ring 32 with conductive adhesive, conductive screws or rivets, or any other suitable electrical connector. However, conductivity through the lower support ring 38 is not necessary due to the conduction through the conductive path that includes the top support ring 32, the strap 34 and the power supply. Therefore the lower support ring 38 can be made of any suitable material that provides the structural strength to withstand the tensile force applied thereto. To enhance the performance of the electrode 30, the electrical contact between the tape 36 and the power supply can be improved by conductively connecting the lower supporting ring 38 to the power supply, for example by a wire (not shown) extending between and welded, or otherwise mounted, to the two supporting rings 32 and 38.

An attachment to the lower support ring 38, such as the strap 39, is biased downwardly to apply a bias, or any other constant tensile force, to the lower ring 38. This bias may be a fixed structure (e.g., the support 22 shown in FIG. 2) with a pre-stressed structure between the strap 39 and the support 22, or a pre-stressed spring or a weight attached to the strap 39. Any of these structures can provide sufficient force directed away, and preferably downwardly in the case of a vertical orientation, from the top ring 32 to keep the flexible tape 36 taut during operation. An example of the amount of weight contemplated for the invention is about 5.0 lbs to about 20.0 lbs. Of course, the person having ordinary skill will understand that this contemplated weight can be modified depending upon the parameters of the system, and will be able to determine how to modify them appropriately.

Multiple electrodes 30 can be arranged in various patterns within an ESP chamber. If a single tape system is desired, the two parallel tapes can be bonded into a single tape along their length between the two rings. Furthermore, the "strap hanger" connection of the top ring 32 to the top support (e.g., the support 20 shown in FIG. 1), and the "strap hanger" of the bottom ring 38 to a weight or the bottom support (e.g., the bottom support 22) is preferably formed to prevent the conductive tape 36 from slipping axially off of the support ring. The straps 34 and 39 surround the rings 32, 38 and the tape 36 to prevent such relative axial movement of the tape 36 and the rings 32, 38. Of course, other immobilizing structures are contemplated and will become apparent to the person of ordinary skill from the disclosure herein. Furthermore, the electrode 30 is suitable for a non-vertical orientation, such as horizontal, in which case the bias applied to the lower ring 38 applying a force away from the upper ring 32 may be a pre-stressed spring or a weight applying a downward force to a flexible cable or other flexible, tension-applying body, to the lower ring 38 after passing through a pulley that re-directs the tensile force of the weight along a line substantially parallel to the long spans of the tape 36.

As shown in FIG. 4, a different electrode 40 is made according to the invention and has a top support ring 42 that is preferably a conductive material, such as metal and is preferably significantly axially longer (along the axis of the ring 42) than the ring 32 of the electrode 30 of FIG. 3. A preferably conductive metal support shaft 44, preferably welded to the top ring 42 about midway along the length of the ring 42, enables the top ring 42 to be suspended (similar to the electrode 30 of FIG. 3) from a support, such as the support 20 of FIG. 1. However, with other, different structures than the shaft 44 the ring 42 can be readily attached in the middle of the ring's 42 length.

A first conductive tape 46*a* and a second conductive tape 46*b* extend around the top ring 42, and the tapes are preferably equivalent to the tape 36, or its alternatives as described above. Electrical conduction between the tapes 46*a* and 46*b* and the ring 42 is important, and so there are similar electrical connections between the tapes and the ring as in the electrode 30 and these include screws, adhesives, etc.

The axial ends of the ring 42 on both sides of the shaft 44 preferably have circumferential grooves (not visible) inset from the ends of the ring 42 to receive and maintain the tapes 46*a* and 46*b* apart at the correct spacing distance along the axial length of the ring 42. The tapes 46*a* and 46*b* can be fixed to the ring as described above for the electrode 30.

The lower support ring 48 can be any suitable material, for similar reasons as in the case of the ring 38 as described above, and preferably with the same geometry as the top ring 42. The lower ring 48 can be attached with a support shaft 49, which can be mounted to a fixed support, such as the support 22 shown in FIG. 2, or to a weight or other bias. It is necessary to create tension in the flexible tapes 46*a* and 46*b* in order to keep the tapes taut, which any of these biases will do. Multiple electrodes 40 can be placed in various patterns within the ESP chamber, and the electrode 40 can be oriented non-vertically, and specifically horizontally, using the biases described above for the electrode 30. The electrodes 30 and 40 are more suitable for horizontal flow ESPs because the tapes thereon can be aligned with the flow of gases through horizontal ESPs.

As shown in FIG. 5, the electrode 50 has a central axis of symmetry in the discharge section of the ESP. Therefore, the electrode 50 produces a more uniform discharge in an upflow ESP with symmetric cross section, and thus the electrode 50 is more suitable to a vertical orientation in an upflow ESP. The electrode 50 has a top support ring 52*b* that is preferably metal and conductive. A support half ring 52*a* is mounted to and extends around the lower portion of the top ring 52*b* and is oriented at an approximately 90 degree angle with the top ring 52*b*. There is preferably an electrical connection between the rings 52*a* and 52*b*.

A first tape 56*a* extends around the half ring 52*a* and a lower support ring 58*a*. The lower ring 58*a* is connected to the lowest support ring 58*b* through a bias, which is preferably the coiled spring 57, but can be replaced by any suitable structure, such as an elastomer, a gas spring, a leaf spring or any suitable spring.

The second tape 56*b* extends from the top ring 52*b* and around the lower ring 58*b*. The upper support strap 54 mounts to the top ring 52*b* and around the second tape 56*b*, and extends conductively to the power supply (not shown). A lower support 59 is mounted to a fixed support, such as the support 22 in FIG. 2, or a weight that serves as a bias. The lower support 59 need not be conductive, as with the lower ring 58*b*.

The electrode 50 has a series of rings and a half ring to make the parallel tape portions of the arrangement symmetrical around the longitudinal axis of the electrode 50. Top attachment 54 and lower attachment 59 adhere to the above parameters for conductivity and tape retention on the support rings. The arrangement of the lower set of rings and half ring (with a coil or other spring 57) is able to achieve tension on both sets of tapes 56*a* and 56*b* when the lower support ring 58*b* pulls from a single point as shown. Thus, all components of the electrode 50 stay symmetrical and both tapes 56*a* and 56*b* are taut when the lower ring 58*b* is pulled in tension.

Tests have been carried out to compare two electrodes: (i) an in house fabricated metal electrode designed on the basis of conventional commercial electrodes (designated "OU-METAL ELECTRODE" in FIG. 6), and (ii) an electrode assembly with suspended carbon fiber tapes based on the design described above and shown in FIG. 5 (designated "CARBON FIBER TAPE" in FIG. 6). The two loops are suspended between steel rings of 2" diameter. The details of this particular electrode are shown in FIGS. 7A, 7B, 8A and 8B. As demonstrated by the V-I plot of FIG. 6, the carbon fiber electrode of the invention provides significantly greater current than the conventional metal electrode. In all tests with different carbon fiber tape electrodes, the electrodes of the invention performed at least as well as a metal electrode of comparable dimensions. The discharge current of the tape electrode can also be varied by changing the number and geometric configuration of tapes on each electrode assembly. As noted above, equal performance by the present invention electrodes, which cost far less than conventional electrodes, is a notable improvement.

Figure 6:
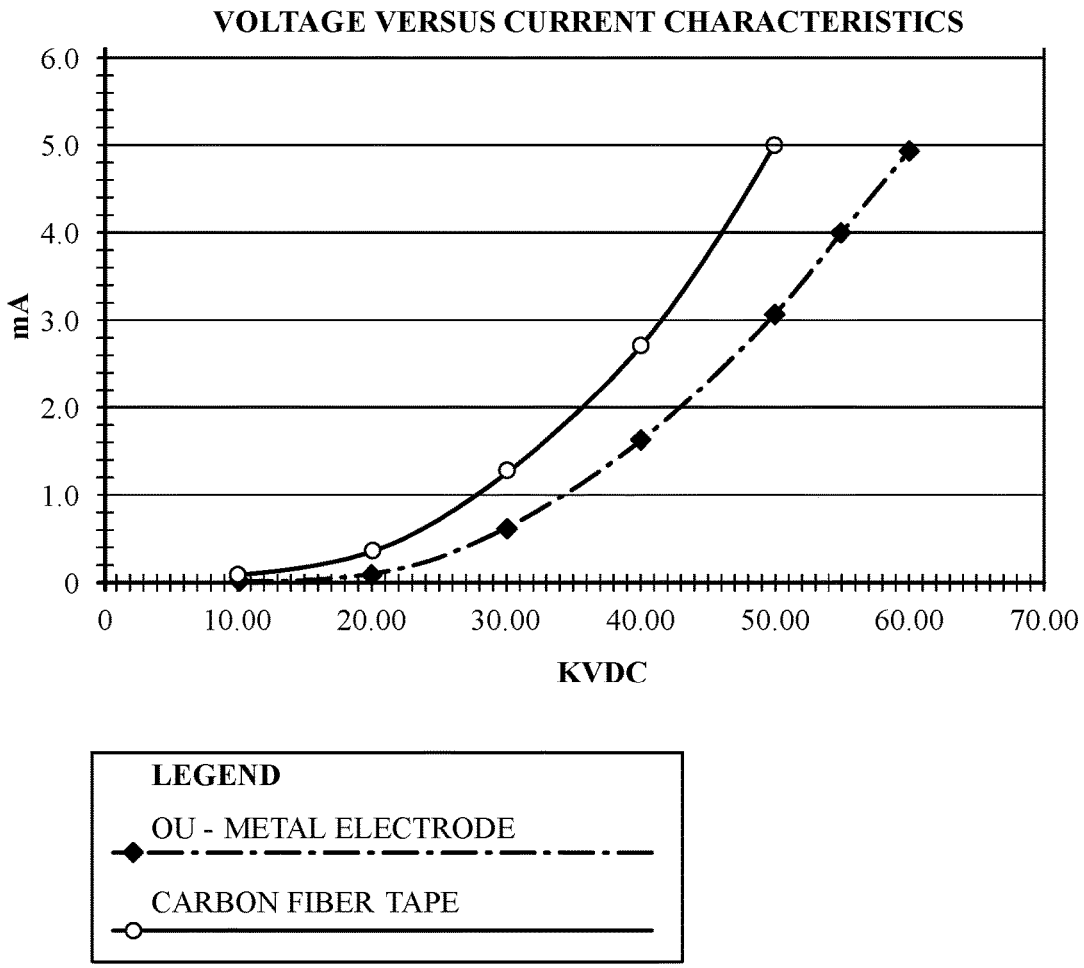
FIG. 6 is a graphical illustration of the performance of an embodiment of the present invention and a prior art discharge electrode showing voltage on the x-axis and current on the y-axis.

The result of the test to compare the V-I characteristics of these two electrodes is shown in FIG. 6. The typical electrode length was 10 feet, and each was tested while suspended inside a grounded metal ESP chamber. The metal chamber 70 is of square cross section (about 12 inches by about 12 inches) and is shown in FIG. 7B.

Figure 7A:
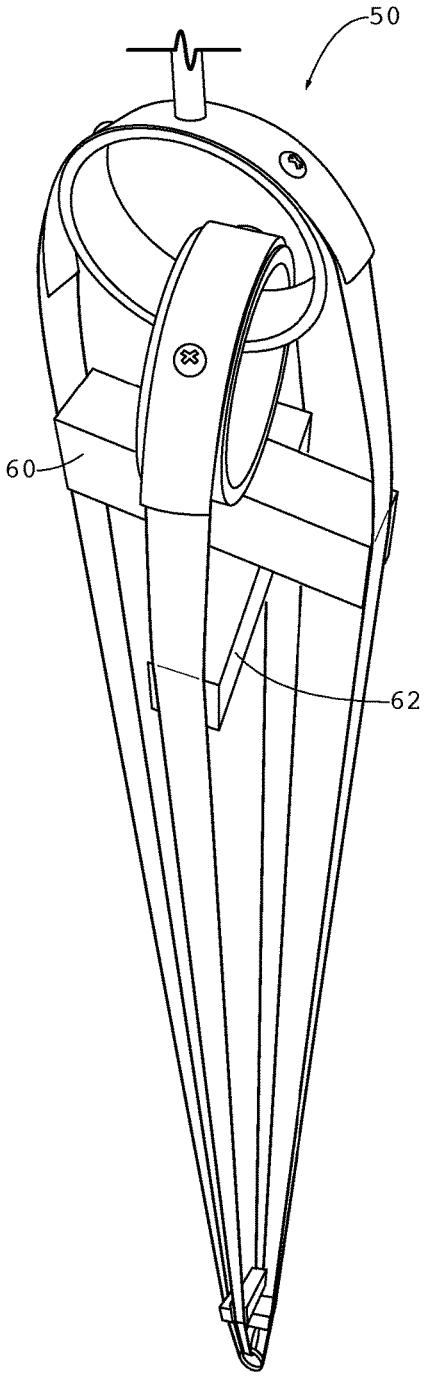
FIG. 7A is view in perspective illustrating an embodiment of the present invention
Figure 7B:
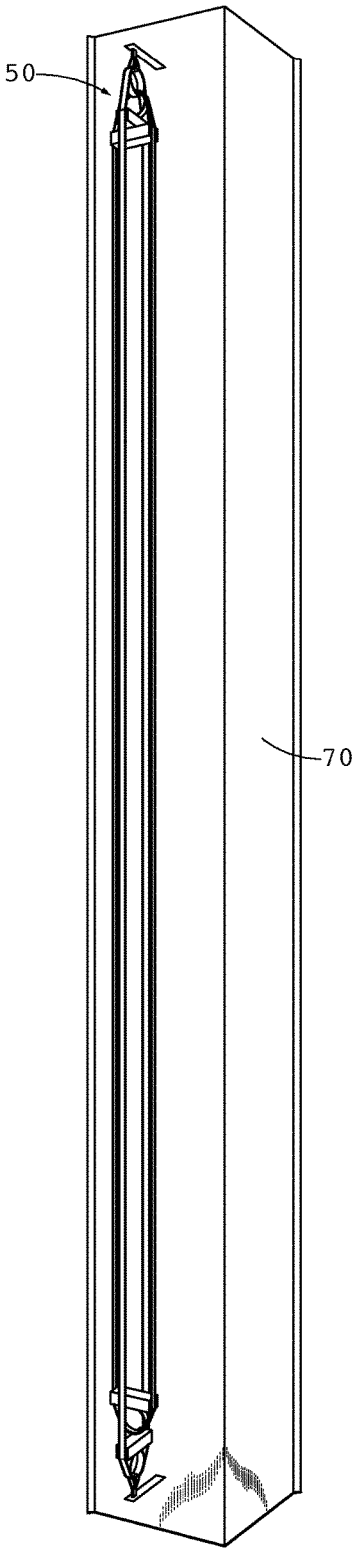
FIG. 7B is a view in perspective illustrating the embodiment of FIG. 7A suspended outside a vertical ESP chamber for demonstration purposes only.

In FIG. 7A, the carbon fiber electrode assembly 50 is viewed near the ring at the top end. White offset bars 60 and 62 were used to match the size of the metal electrode for proper comparison of performance. In FIG. 7B, the same electrode 50 is shown suspended outside the vertical ESP chamber 70. Experiments were conducted with each electrode suspended inside the ESP chamber 70.

Figure 8A:
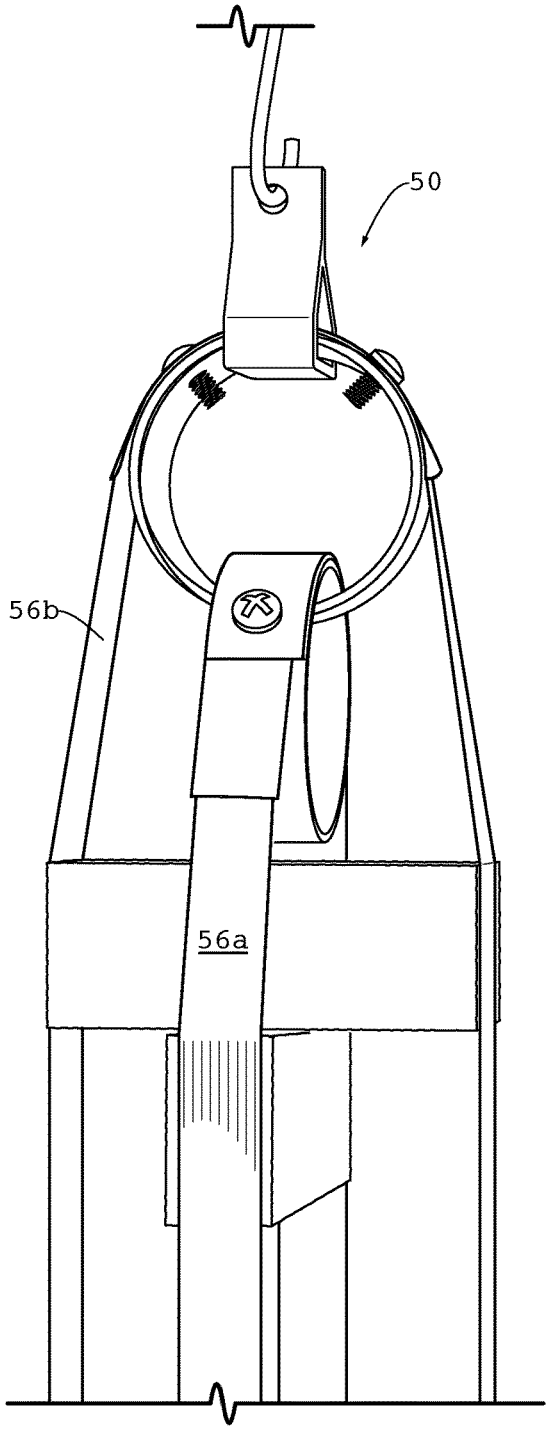
FIG. 8A is a view in perspective illustrating the top end of the embodiment of FIG. 7A.
Figure 8B:
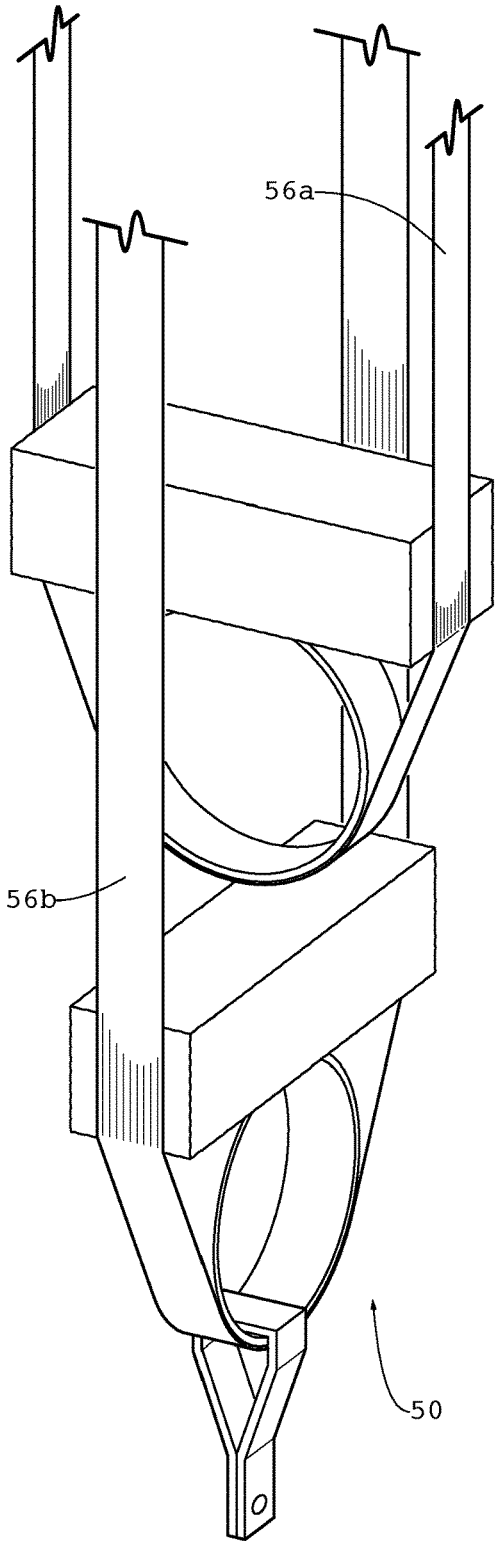
FIG. 8B is a view in perspective illustrating the bottom end of the embodiment of FIG. 7A.
Figure 9:
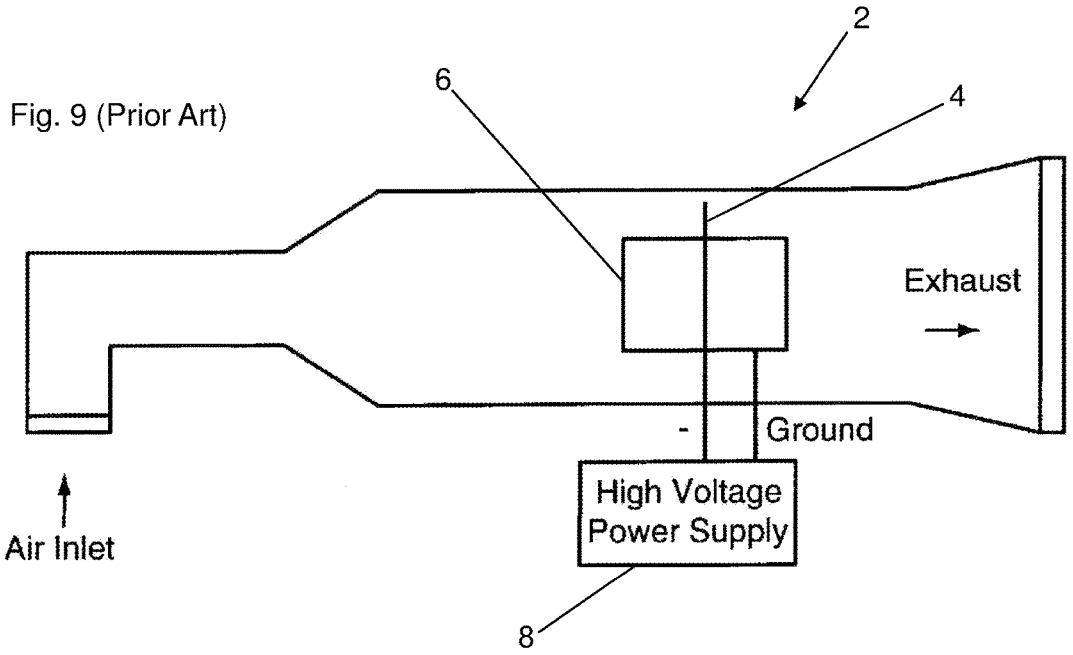
Fig. 9 (Prior Art)
FIG. 9 is a schematic illustration of a prior art electrostatic precipitator.

In FIGS. 8A and 8B, views of the top and bottom ends of the carbon fiber tape electrode 50, showing the two rings supporting the two loops of the conductive tapes. The two loops of tapes 56*a* and 56*b* are perpendicular to each other. Each loop has a white offset bar to maintain the desired distance between the two halves of the loop. In practice, the plastic offset bars can be eliminated by using metal rings of diameter equal to the desired distance between the parallel tapes.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A discharge electrode for use in an electrostatic precipitator having a power supply connected to at least one collection electrode and having a flow of gas and particles across the discharge electrode and said at least one collection electrode, the discharge electrode comprising:

(a) a first support;

(b) a second support spaced from the first support with a first gap between the first and second supports;

(c) a group of carbon fibers seating against one another in a substantially parallel orientation and infiltrated by a matrix material to form a first composite that extends around the first and second supports and is exposed to the flow of gas, wherein the first composite is electrically connected to the power supply;

(d) a bias mounted to the second support applying a longitudinal force to the second support directed away from the first support, the bias thereby applying to the first composite a longitudinal force that tends to maintain the first composite substantially taut between the first and second supports;

(e) a third support extending from the first support;

(f) in a fourth support spaced from the third support with a second gap between the third and fourth supports and a third gap between the second and fourth supports;

(g) a second composite formed from carbon fibers seating against one another in a substantially parallel orientation infiltrated by a matrix material, wherein said second composite extends around the third and fourth supports, is exposed to the flow of gas, and is electrically connected to the power supply; and (h) a second bias mounted to the second and fourth supports and applying a longitudinal force to the fourth support directed away from the third support, the second bias thereby applying to the second composite a longitudinal force that maintains the second composite substantially taut between the third and fourth supports.

2. The discharge electrode in accordance with claim 1, wherein the third and fourth supports are transverse to the first and second supports, thereby disposing portions of the second composite substantially parallel to portions of the first composite and spaced therefrom.

3. The discharge electrode in accordance with claim 2, wherein the first, second and fourth supports are cylindrical rings, and the third support is a section of a cylindrical ring.

4. The discharge electrode in accordance with claim 3, wherein the second bias is a spring mounted in the third gap.

5. The discharge electrode in accordance with claim 1, wherein the carbon fibers include at least some carbon nanofibers.

6. The discharge electrode in accordance with claim 1, wherein the first support is conductively mounted to the power supply.

7. The discharge electrode in accordance with claim 6, wherein the second support is disposed below the first support in an operable orientation.

8. The discharge electrode in accordance with claim 1, wherein the first and second supports are cylindrical rings.

* * * * *